United States Patent [19]

Gisbourne

[11] 4,119,754

[45] Oct. 10, 1978

[54] PAPERMAKERS FABRICS

[75] Inventor: Bryan James Gisbourne, Blackburn, England

[73] Assignee: Scapa-Porritt Limited, Blackburn, England

[21] Appl. No.: 736,161

[22] Filed: Oct. 27, 1976

[30] Foreign Application Priority Data

Oct. 30, 1975 [GB] United Kingdom ..... 44799/75

[51] Int. Cl.[2] ..... B05D 3/02; B32B 27/38

[52] U.S. Cl. ..... 428/255; 427/385 B; 427/386; 427/428; 428/413; 428/474; 428/480; 428/483; 428/524

[58] Field of Search ..... 427/385 B, 386, 428; 428/413, 474, 480, 483, 524, 255

[56] References Cited

U.S. PATENT DOCUMENTS

| | | | |
|---|---|---|---|
| 2,787,570 | 4/1957 | Lott et al. | 428/255 X |
| 2,874,729 | 2/1959 | Ball | 428/255 X |
| 2,903,381 | 9/1959 | Schroeder | 427/390 X |
| 3,032,441 | 5/1962 | Beaumont et al. | 428/255 X |
| 3,054,690 | 9/1962 | Miller et al. | 427/390 X |
| 3,480,547 | 11/1969 | Van Dyk | 427/390 X |

*Primary Examiner*—Michael R. Lusignan

*Attorney, Agent, or Firm*—Shoemaker and Mattare, Ltd.

[57] ABSTRACT

A papermakers fabric formed from yarns of synthetic polymeric material has a coating of a different polymeric material of better abrasion resistance applied to the yarns.

20 Claims, No Drawings

PAPERMAKERS FABRICS

This invention relates to papermakers fabric.

In the manufacture of paper, the usual procedure involves the application of a liquid suspension of cellulosic fibres mixed with other materials appropriate to the paper being produced to an endless band having an openwork mesh structure which is supported on rollers. The rollers are rotated to drive the band and excess water is drained through the band, usually with the assistance of suction devices, to form a moist cellulosic web. Further water is subsequently removed from this web by passing same through a roller nip and the web is then dried over heated rollers.

The openwork mesh band was originally formed from woven metal wires, particularly phosphor-bronze wires, but now it is usual to use 'wires' formed from synthetic polymeric materials, such as monofilament polyester yarns.

With such synthetic materials, and in the case where the liquid suspension contains in addition to the cellulosic fibres an abrasive filler material such as calcium carbonate, the problem arises that the mesh may become rapidly worn, and the working life thereof consequently appreciably reduced, due to abrasion occurring as the mesh moves against the rollers and suction devices. Of course compensation for this could be effected by using thick yarns but this would give a coarse mesh with poor drainage characteristics.

An object of the present invention is to provide an open-work mesh band for use as a papermakers wet end fabric with which abrasion resistance and therefore working life can be improved without appreciable adverse modification of texture and drainage characteristics.

According to one aspect of the invention therefore an openwork mesh band for use as a papermakers wet end fabric formed from yarns of synthetic polymeric material is characterised by the provision of a coating of a different synthetic polymeric material having better abrasion resistance than the material of said yarns, said coating being substantially wholly in the form of a coherent continuous thin film extending substantially only over the surfaces of the yarns and being intimately bonded thereto.

With this arrangement it has been found possible to achieve unexpectedly good abrasion resistance without appreciably adversely modifying the mesh texture and drainage characteristics.

The improvement of abrasion resistance is unexpected in so far as the use of a thin film would be expected to wear away and therefore lose its protective properties almost immediately. It has been found that the continuous coherent nature of the thin film and the intimate bond between same and the yarns contribute significantly to the improvement of abrasion resistance and other forms of coating do not give the same improvement.

The use of a coating which is substantially wholly in the form of a thin film and which extends substantially only over the yarn surfaces, that is a coating which does not to any appreciable extent cover openings in the fabric or form agglommerations at yarn crossings, ensures that there is no adverse modification of mesh texture and drainage characteristics as already mentioned.

The polymeric coating material may be any suitable material but is preferably a thermosetting resin particularly an epoxy and/or phenolic resin. Alternatively or additionally a thermoplastic resin may be used such as polytetrafluoroethylene.

The polymeric yarns may be of any suitable chemical composition and physical structure and will normally be monofilament yarns preferably polyester yarns of the polyethyleneteraphthalate kind (for example as sold under the Trade Mark TREVIRA). Alternatively or additionally polyamide yarns (such as nylon yarns) and/or any other material such as is conventionally used in papermakers fabrics may be employed.

In order to ensure no appreciable adverse modification of drainage properties, the addition of coating material should preferably amount to no more than 10% of the weight of the fabric and in a particularly preferred embodiment an addition in the range 1½ to 2% is used.

Preferably, in order to form the thin film, and in accordance with a second aspect of the present invention, the polymeric coating material is applied to the fabric in solution in a volatile medium, preferably non-aqueous, said medium then being removed by evaporation so as to deposit the coating material on the fabric yarns.

With this method it has been found possible to form the required thin film on the yarns.

Preferably the solution is applied to the fabric so as just to saturate the fabric. This may be effected in any suitable manner such as spraying, dipping or the like, but most preferably a procedure is used which involves transfer of liquid to the fabric by capillary action whereby the fabric can be just saturated without requiring excess liquid to be removed by drainage. Thus, for example, the fabric may be moved over and in contact with an applicator roll which is rotatably mounted and dips in a tray of said solution.

The evaporation of the solvent may be effected by air drying using blowers and/or heaters if required.

The solvent will be selected in accordance with the polymeric material but is preferably an organic solvent. Isopropanol has been found suitable for phenolic resins and ethyl acetate has been used for epoxy resins. Other solvents such as methanol or solvent mixtures may be used.

If desired additional materials may be mixed with or dissolved in the solution so as to be deposited with the dissolved coating material. Thus, for example finely divided polytetrafluoroethylene powder may be dispersed in the solution. Such powder may be added to 10% of the weight of phenolic resin in an isopropanol solution of 3½% by weight phenolic resin.

After evaporation of the solvent, the deposited resin on the fabric may then be cured by application of heat in any suitable manner.

In one Example of the invention a wet end papermakers fabric is treated with a solution of phenolic resin (type F79 supplied by FERS of Barcelona) in isopropanol. The fabric is woven from monofilament polyester yarns (such as Trevira) both in warp and weft, there being 30 warp ends and 24 weft picks per centimeter, the warp and weft yarns both being 0.2mm diameter. The resin is supplied as a liquid phenolin resin containing 70% by weight solids in isopropanol and this is diluted with further isopropanol to give 3½% by weight resin. The resin is of the phenol-aldehyde (more particularly phenolformaldehyde) kind and is readily soluble even in isopropanol/water mixtures. Indeed, if desired up to 30% by weight of the isopropanol may be replaced by water in the above mentioned resin solution whilst retaining the resin in solution.

The treatment of the fabric is effected by running same held taut and horizontal over and in contact with a horizontal rotatably mounted roll which dips in a tray of the solution. The roll is driven in the same direction as the fabric but with a surface speed 3½ times that of the fabric. The solution is picked up on the surface of the roll and is applied to the underside of the fabric. The solution transfers to the fabric due to capillary action until the fabric is saturated, by which is meant saturation of spaces between fibres.

The fabric is then dried by running same in the air so that the solvent evaporates depositing the resin on the yarns. The deposited resin is then cured, for example by running the fabric past infra-red heaters and the cured resin forms a thin coherent film covering all yarn surfaces but not extending across spaces between yarns nor agglommerating at yarn crossings. Effectively the yarns become sheathed with sleeves and have uniform thickness walls which are securely mechanically bonded to the yarns over the entire surface of the yarns.

The pick-up of resin coating amounted to 3½% of the fabric weight, although as previously mentioned a pick up of 1½ to 2% would normally be adequate.

Tests were then carried out on untreated fabric and also fabric treated with the phenolic resin.

The comparative tests were as follows:

The fabric was held, under tension, in contact with the upper part of the periphery of a disc rotating in a vertical plane, whilst a slurry of an abrasive material commonly used in papermaking was continuously applied to the outer surface of the fabric.

At intervals the sample was removed from the test rig and the thickness thereof was measured. The disc was rotated at the same speed, the tension applied to the sample remained constant and the slurry was applied at a constant rate throughout all of the tests.

The abrasive material used was calcium carbonate.

The following results were obtained:

| | Thickness in (mm) | |
|---|---|---|
| Time in Minutes | Uncoated Sample | Phenolic Resin Coated Sample |
| 0 | 0.49 | 0.49 |
| 10 | 0.37 | 0.41 |
| 40 | 0.25 | 0.32 |

In a second example separate samples of the same kind of woven fabric were treated respectively with a phenolic resin in like manner to the first example and with an epoxy resin. The epoxy resin sample was obtained by treating the fabric with an ethylacetate solution of polyamide cured epoxy resin to give the same weight pick up as with the phenolic resin.

The woven fabric had monofilament polyester yarns both in the warp and in the weft, there being 26 warp yarns and 20 weft yarns per centimeter, each yarn being 0.25mm in diameter. The samples were subjected to the same test as described in the first example and results were obtained as follows:

| Time in Minutes | Uncoated Sample | Epoxy Resin Coated Sample | Phenolic Resin Coated Sample |
|---|---|---|---|
| 0 | 0.55 | 0.55 | 0.55 |
| 10 | 0.43 | 0.47 | 0.49 |
| 20 | 0.38 | — | — |

-continued

| Time in Minutes | Uncoated Sample | Epoxy Resin Coated Sample | Phenolic Resin Coated Sample |
|---|---|---|---|
| 40 | 0.325 | 0.38 | 0.44 |

From the foregoing examples, it can be seen that the coating of the fabric with the epoxy resin, in an amount of 3.5% by weight, improved the resistance to abrasion, and with the phenolic resin, again 3.5% by weight, gave a still better improvement.

Unexpectedly the coated fabrics of the above mentioned examples were also found to give advantages in terms of reduction of power consumption to drive the fabric in a papermaking machine and improved suction in the vacuum dewatering apparatus. Thus, for example, an uncoated fabric on a papermaking machine ran at 668 meters/min at a power consumption of 422Kw and a vacuum dewatering pressure of 17.2cm Hg whereas the same fabric coated with the phenolic resin as described in the examples ran on the same machine at 679 meters/min at a power consumption of 306Kw and a vacuum dewatering pressure of 14.8cm Hg.

What I claim is:

1. An open mesh band for use as a papermakers fabric comprising:

monofilament yarns, each yarn having an outer surface and being comprised of a synthetic polymeric material;

sheaths for each of said yarns, each sheath including a second synthetic polymeric material having abrasion resistance which is greater than said first synthetic material and being in the form of a coherent continuous thin film, said second synthetic polymeric material comprising less than ten percent of the weight of the papermakers fabric; and said films being bonded directly to each of said yarns only at said outer surfaces of said yarns so that openings in said monofilament yarns are not covered.

2. A papermakers fabric according to claim 1 wherein the polymeric coating material is a thermosetting resin.

3. A fabric according to claim 2 wherein the resin is an epoxy resin.

4. A fabric according to claim 1 wherein the polymeric yarns are polyester yarns.

5. A fabric according to claim 1 wherein the polymeric coating material includes polytetrafluoroethylene.

6. A method of coating monofilament yarns of an open mesh band comprising the steps of:

dissolving a thermosetting resin in a non-aqueous volatile medium to form a coating solution;

applying said coating solution to an open mesh band; and evaporating said non-aqueous volatile medium to deposit said resin on the yarns in the form of a thin film bonded thereto only at the outer surfaces of said yarns, said thermosetting resin being provided in a quantity sufficient so that said resin comprises less than ten percent of the weight of the open mesh band.

7. The method of claim 6, further including a step of curing said deposited resin.

8. The method of claim 7, wherein said curing step includes applying heat to the coated yarns.

9. A method according to claim 6 wherein the solution is applied to the fabric so as to saturate same.

10. A method according to claim 9 wherein the application is effected by a procedure involving transfer of liquid to the fabric by capillary action.

11. A method according to claim 10 wherein said procedure involves moving the fabric over and in contact with an applicator roll which is rotatably mounted and dips in a tray of said solution.

12. A method according to claim 9 wherein said medium is an organic solvent.

13. A method according to claim 9 wherein polytetrafluoroethylene powder is dispersed in the solution.

14. The method of claim 6, wherein the step of applying said coating solution to the open mesh band includes steps of:

moving the mesh against a moving roll;

coating said roll with said solution; and transferring said solution from said roll to the mesh.

15. The method of claim 14, wherein said roll contacts the mesh on only one side thereof.

16. The method of claim 15, further including the step of rotating said roll in the direction of mesh movement.

17. The method of claim 16, wherein said roll has a surface speed greater than that of the mesh.

18. The method of claim 14, wherein the mesh moves horizontally.

19. An open mesh band for use as a papermakers fabric produced by the method of claim 6.

20. A fabric according to claim 2, wherein the resin is a phenolic resin.

* * * * *